US006588049B2

(12) United States Patent
Sundgaard

(10) Patent No.: US 6,588,049 B2
(45) Date of Patent: Jul. 8, 2003

(54) CLEANING INSTALLATION AND DEVICE FOR REMOVING SOOT OR SIMILAR DEPOSITS

(75) Inventor: Knud Sundgaard, Skanderborg (DK)

(73) Assignee: OKR Cleaning, Skanderborg (DK)

( * ) Notice: Subject to any disclaimer, the term of this patent is extended or adjusted under 35 U.S.C. 154(b) by 0 days.

(21) Appl. No.: 09/775,023

(22) Filed: Feb. 1, 2001

(65) Prior Publication Data

US 2001/0014992 A1 Aug. 23, 2001

(30) Foreign Application Priority Data

Feb. 23, 2000 (EP) ..... 00200630
May 1, 2000 (EP) ..... 00201547

(51) Int. Cl.[7] ..... F23J 3/02
(52) U.S. Cl. ..... 15/317
(58) Field of Search ..... 15/316.1, 317; 122/390, 391

(56) References Cited

U.S. PATENT DOCUMENTS 2,897,532 A * 8/1959 Cantieri ..... 15/317
3,816,871 A * 6/1974 Karnofsky ..... 122/392
4,173,808 A * 11/1979 Blaskowski ..... 15/316.1
4,204,496 A * 5/1980 Ikegami et al. ..... 118/405
4,359,800 A * 11/1982 Ziels ..... 15/316.1
4,874,037 A 10/1989 Papst et al.
5,241,723 A * 9/1993 Garrabrant ..... 122/390
5,320,072 A * 6/1994 Theiss et al. ..... 122/382
5,517,950 A 5/1996 Kendrick
5,724,829 A 3/1998 Schubach et al.

FOREIGN PATENT DOCUMENTS

DE 34 09 995 3/1985
EP 0 865 023 9/1998

* cited by examiner

*Primary Examiner*—Chris K. Moore
(74) *Attorney, Agent, or Firm*—Merchant & Gould P.C.

(57) ABSTRACT

The present invention relates to a device for use in a cleaning installation for removing soot or similar inside deposits in a flow channel in a processing system such as a boiler, heat exchanger, flue gas filter or the like, by intermittently blasting a fluid or gaseous medium into the processing system, said device comprising a flow passage between the associated valve means and the flow channel, wherein the flow passage is provided with an inlet allowing for a continuous flow of protective gas around the flow passage into the flow channel in the processing system. By the present invention, corrosion is reduced since a cushion of air is generated at the end of the flow passage during off-cycles of the cleaning operation as air is constantly drawn or forced in through the inlet. This means that the components are covered by this cushion and protected against corrosive gasses in the heat exchanger or the like. Hereby, the valve means are protected from corrosion and tests have shown that durability of the exposed components facing the inside of the boiler or the like has been significantly improved.

12 Claims, 5 Drawing Sheets

CLEANING INSTALLATION AND DEVICE FOR REMOVING SOOT OR SIMILAR DEPOSITS

Figure 1:
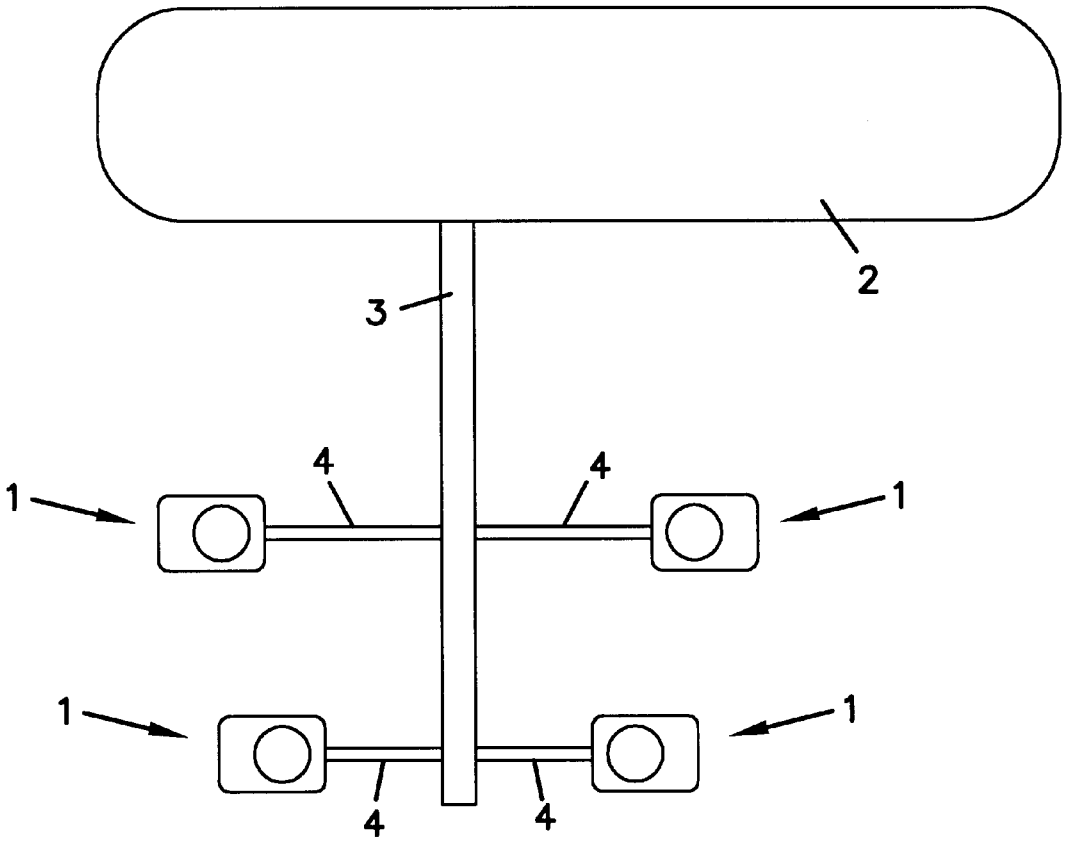

The present invention relates to a device for use in a cleaning installation for removing soot or similar inside deposits in a flow channel in a processing system such as a boiler, heat exchanger, flue gas filter or the like, by intermittently blasting a fluid or gaseous medium into the flow channel in the processing system, said device comprising a flow passage between associated valve means and the processing system. The invention also relates to a cleaning installation of such kind.

Boiler installation sediments of soot or the like often occur on the inside of heat surfaces and on tubes that are in contact with flue gases. This seriously reduces the thermal conductivity and thereby also the efficiency of the boiler if not removed.

For removal of these deposits, methods are known, such as mechanical cleaning or blast cleaning using stream, water or air as cleaning means for the removal of soot. Some of these cleaning methods require shut-down of the boiler installation whilst other methods allow for the boiler to remain in operation at a reduced level of efficiency. By a few methods such as blast cleaning with air, the cleaning process can be performed during ordinary operation of the boiler. An example of another of such systems is known from EP-A-0 865 023 where a sound generator is used for loosening the sediments.

The cleaning equipment is often subjected to a heat and corrosive impact from the gases inside the boiler installation. This results in a limited durability of the cleaning equipment due to the aggressive environment in the flue gases. For this reason, the cleaning equipment is often mounted on the outside of the gas chamber of the boiler.

Equipment for blast cleaning for the removal of soot by pressurized air, is attractive in use since the equipment only requires a small amount of space outside the boiler and none at all inside the boiler.

The cleaning equipment typically comprises a pressure vessel from which pressurized air is fed to a number of diaphragm valves. The valves are controlled by control means. The control means activates the valves in a preprogrammed sequence and the pipes in the boiler governed by the associated valve are blasted with the pressurized air.

The air is blasted for 0,1–1 second at an interval of approx. 2–10 minutes. This cleaning cycle, i.e. the duration and the frequency, can be adjusted according to requirements, such as the type of fuel, the amount of fouling and the boiler output. The pressure vessel is usually operated at about 7–8 bars. However, this can also be adjusted in accordance with the actual needs of the boiler installation.

However, permanent mounting of the blasting tubes in the boiler wall causes a deterioration of the components in the soot removal equipment exposed to the gases inside the boiler and in particular to valve and membrane components.

There are many different types of boilers in power plants. Particularly municipal waste burning plants, bio-mass fuelled plants and waste heat recovery installations generate corrosive flue gases during the burning process.

The components are in particular subject to corrosion due to the hot, aggressive flue gases during the off-cycles, i.e. when no air is blasted through the valve assembly, the associated tube passage and into the boiler. When there is no forced air flow in the valve assembly, flue gas will escape from the main gas stream in the boiler and fill the passage space. This causes mechanical wear and corrosion of the exposed components of the cleaning equipment which, in turn, reduces the cleaning efficiency and again causes a drop in the efficiency of the boiler installation.

Therefore, the object of the invention is to provide a device that reduces corrosion of the exposed components of the cleaning equipment in a soot cleaning installation.

This object is achieved by a device and a cleaning installation of the initially mentioned kind wherein the flow passage is provided with an inlet allowing for a continuous flow of protective gas around the flow passage into the flow channel in the processing system.

By the present invention, corrosion is reduced since a cushion of air is generated at the end of the flow passage during the off-cycles of the cleaning operation, as air is constantly drawn or forced in through the inlet. This means that the components are covered by this cushion and protected against the corrosive gases in the heat exchanger or the like. Hereby, the valve means are protected from corrosion and tests have shown that durability of the exposed components facing the inside of the boiler or the like has been improved significantly. This also means that the components, such as the valve housing, may be produced in a cheap material such as cast iron without compromising the durability of the valve means.

In the preferred embodiment of the invention, the flow passage comprises an annular space between an inner tubular and an outer tubular member, where the outer tubular member is provided with an air inlet generating a continuous air flow around the flow passage into the processing system. Hereby, an even distribution of the air flow is ensured resulting in a particularly well-covering cushion of air.

In a first embodiment of the invention, the air is simply drawn in around the flow passage and into the inside end region of the flow passage utilizing the Venturi effect due to the speed of the gas flow in the boiler, heat exchanger or the like. However, in an alternative embodiment, the air inlet is provided with an injector for the supply of air into the flow passage. This means that air can be forced into the air inlet for the creation of the protective air cushion at the inside end section, even if the sub-pressure created by the flow rate of the gases or the like is insufficient for the creation of an air cushion.

In another embodiment, the device is provided with a plurality of air inlets. Hereby, the amount of air can be enhanced and the shape of the air cushion can be adjusted according to the radial position of the air inlets around the flow passage.

In a preferred embodiment of the invention, the air inlet is provided with replaceable flow restriction means. In a particular embodiment, the replaceable flow restriction means may consist of a cover plate provided with one or more apertures through which air is allowed to flow into the annular spacing. Hereby, the continuous inlet air flow can be restricted so that the amount of incoming air is not influencing the gases inside the boiler.

In another aspect of the invention, a valve assembly is provided for use in a cleaning installation for removing soot or similar inside deposits in a flow channel in a processing system such as a boiler, heat exchanger, flue gas filter or the like, by intermittently blasting a fluid or gaseous medium into the processing system, said valve assembly comprising a diaphragm valve including a first and second chamber, said first chamber receiving pressurized air from an air supply, and said second chamber being provided with valve control means and an outlet for release of air in the chamber when activating the diaphragm valve, and a valve outlet connected with a flow passage device according to the first aspect, wherein flow communication means is provided between the outlet of the second chamber and the inlet of the flow passage of the device.

When the diaphragm valve releases pressurized air which is typically up to 8 bars or perhaps more, the diaphragm retention air is released from the second chamber through the outlet and into the atmosphere. This creates a loud explosion-like noise, that can be more than 100 dBA. However, by a valve assembly according to the invention, a silencer is provided whereby noise emission is reduced considerably.

In the preferred embodiment of a valve assembly according to the invention, the flow communication means includes a tubular pipe. Hereby, the noise reduction may be obtained in a simple and reliable manner, just as a tubular pipe is relatively easy to incorporate in existing valve arrangements.

In another embodiment of the valve assembly, the flow communication means includes an additional supply of external air to the inlet of the flow passage device and this additional air supply preferably consists of cool air. Hereby, a constant air flow to the flow passage may be ensured, just as heat generated during the retention pressure release may be removed by an additional supply of cool air.

Figure 2:
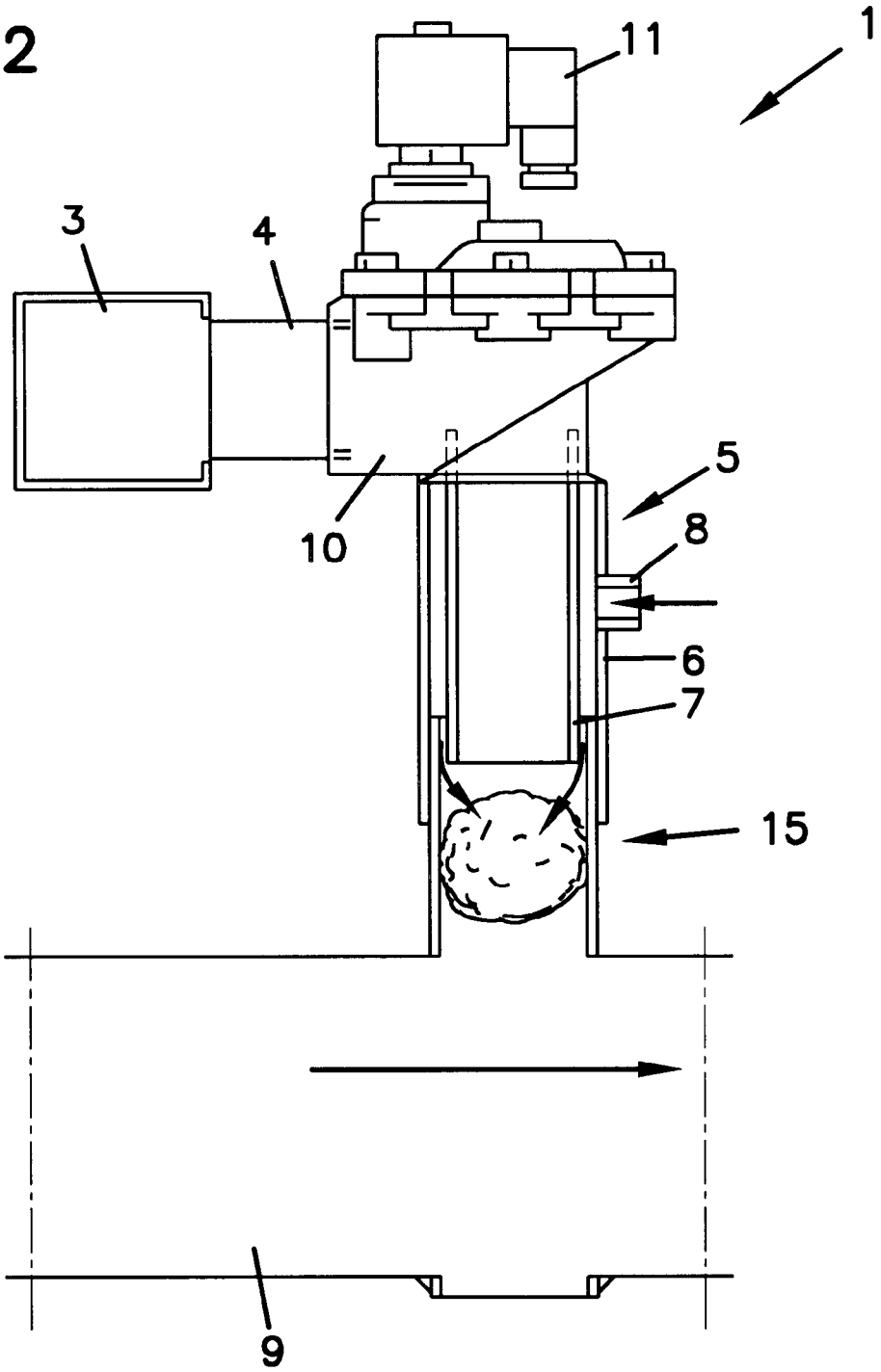
Figure 3:
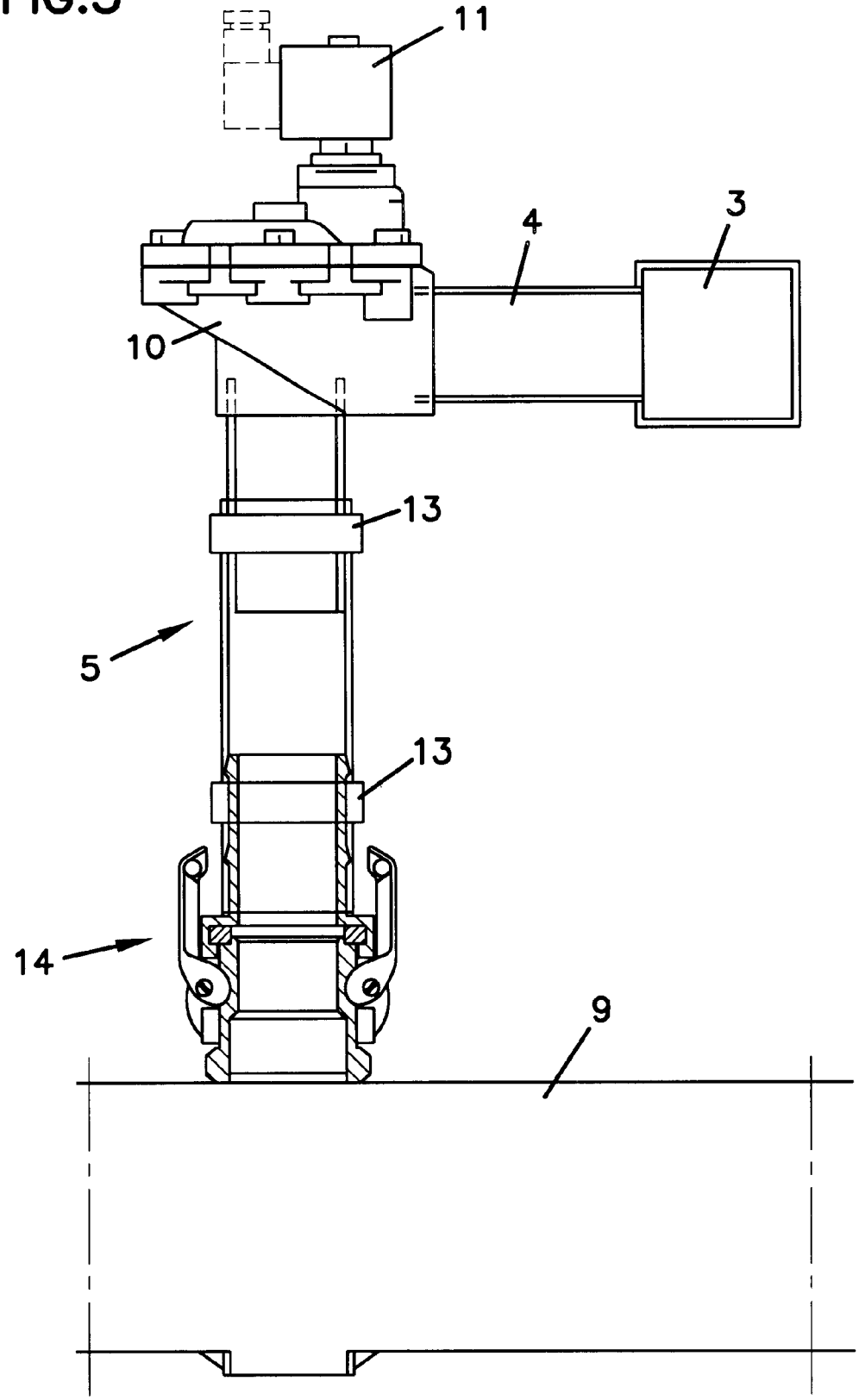
Figure 4:
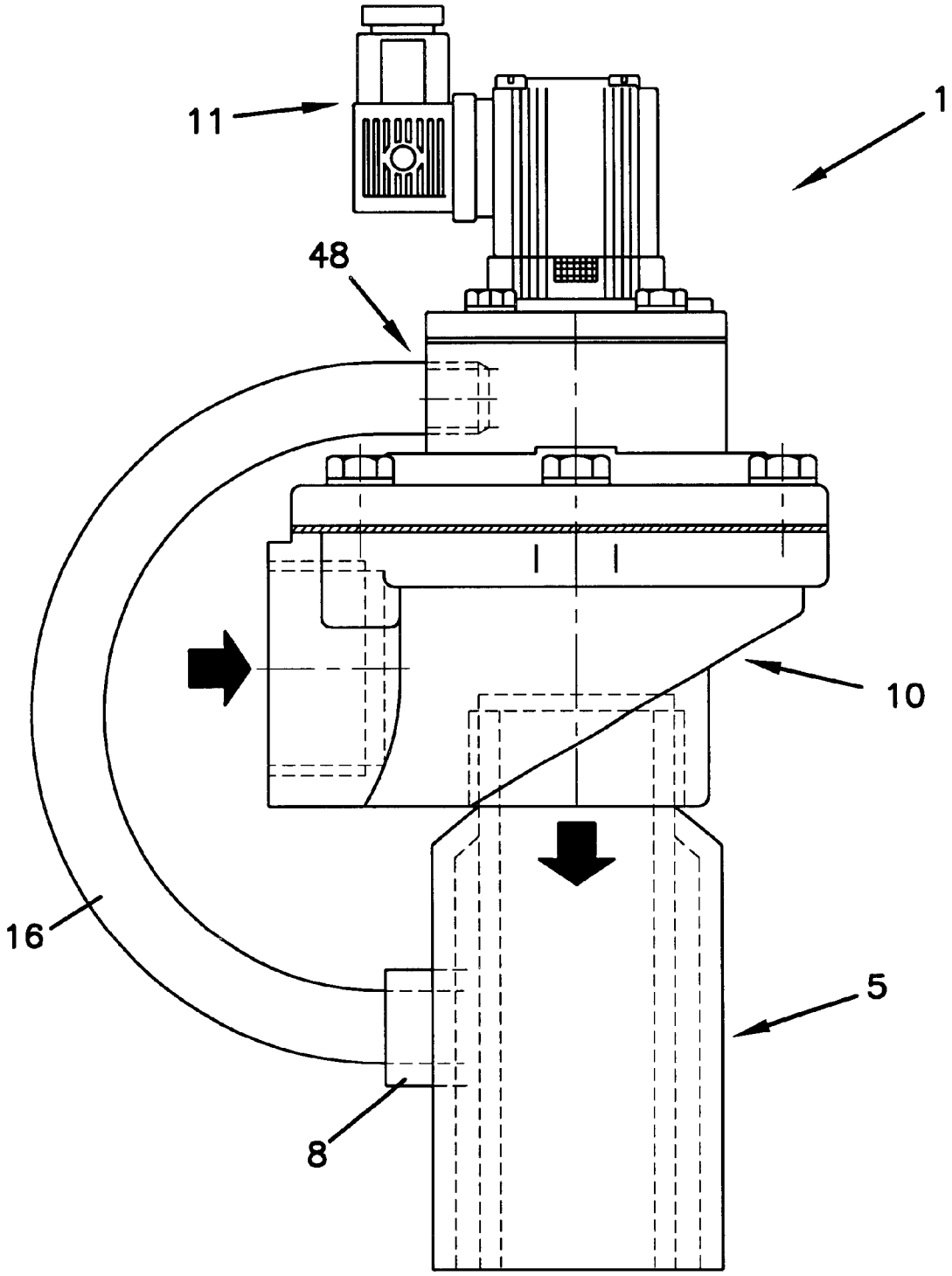
Figure 5:
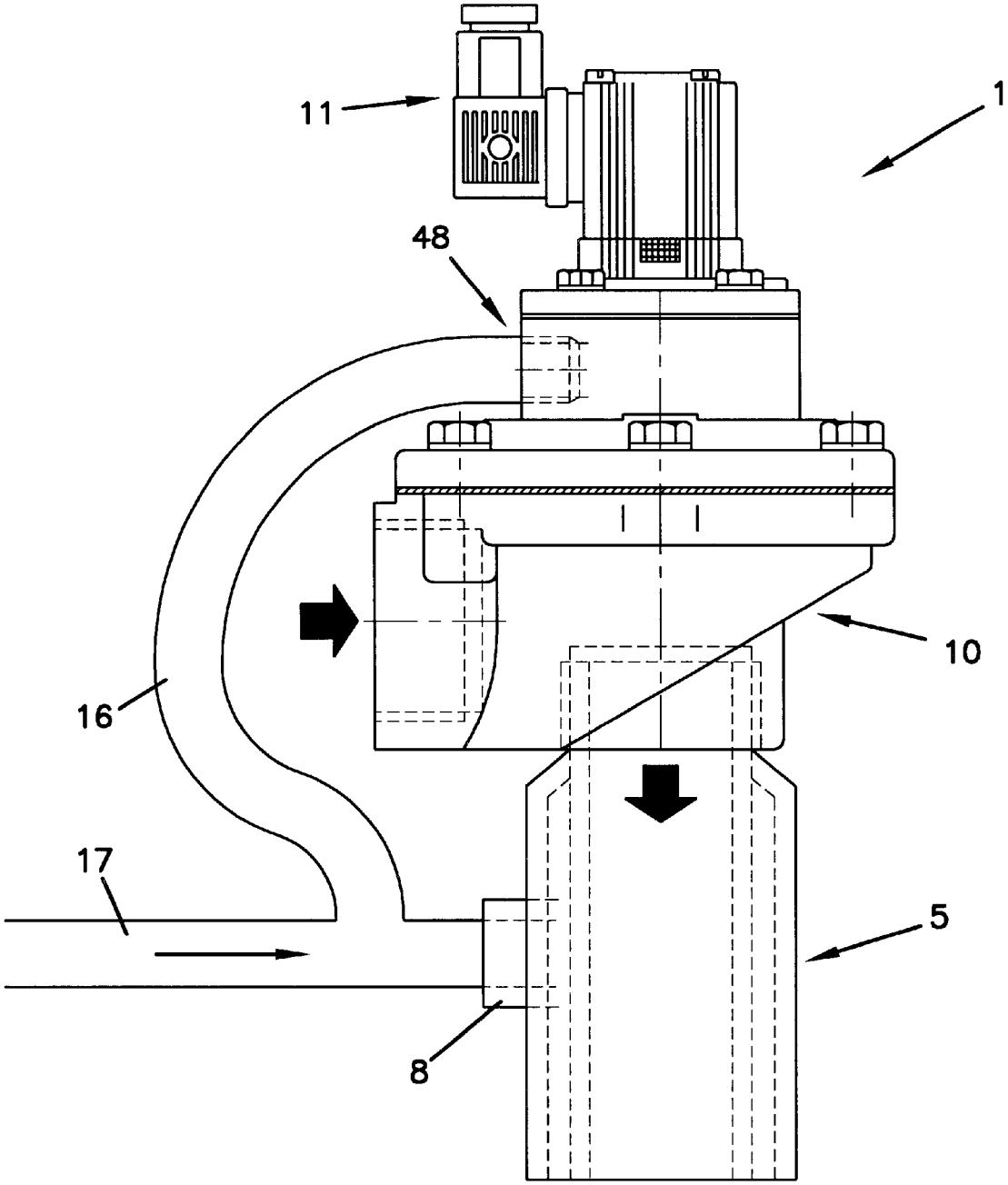

The invention is described in detail in the following with reference to the accompanying drawings, in which FIG. 1 shows a schematic view of a cleaning installation, FIG. 2 shows a schematic view of a cleaning device according to a preferred embodiment of the invention, FIG. 3 shows a schematic view of another type of cleaning device according to prior art, and FIGS. 4 and 5 show two embodiments of a valve assembly with silencing means according to the invention.

FIG. 1 shows a cleaning installation for pressurized air blast cleaning for removal of sediments inside a heat exchanger, boiler or similar preferably tubular installation. The installation comprises a number of valve assemblies 1 connected to a vessel 2 of pressurized air. The vessel 2 is in communication with the individual valve assemblies 1 through a main line 3 and associated supply lines 4. The valve assemblies are controlled by a control system (not shown) by which the operating cycle of the individual valve assemblies 1 and the cleaning cycle as a whole is commanded.

The valve assembly 1 is shown in detail in FIGS. 2 and 3. As shown in FIG. 2, the valve assembly 1 comprises a solenoid valve 10 which is provided with control means 11 for controlling the valve 10. The valve 10 is supplied with pressurized air from the supply lines 3, 4. When the valve 10 is opened, pressurized air is blasted into a flow passage 5 and into a flow channel 9 of a processing system, such as a boiler or the reverse chamber in a heat exchanger, so as to remove soot or similar deposits in the flow channel.

The flow passage 5 comprises in the preferred embodiment of the invention a double walled tubular structure comprising an inner tubular member 7 and an outer tubular member 6 arranged concentrically. The outer member 6 is provided with an air inlet 8 through which air can be drawn, e.g. by use of the Venturi effect, or forced (not shown) into the annular space between the two tubular member 6, 7. From this annular space, air is drawn into the end section of the flow passage 15 where a cushion of air is formed during off-cycle, i.e. between the intermittent blasts, thus preventing the flue gases in the flow channel 9 from entering the flow passage and coming into contact with and corroding the components of the valve 10.

Air or any similar protective gas can be sucked in towards the flow channel 9 due to the flow of gas in the flow channel 9. Alternatively, air can be supplied by connecting an air or a gas supply with the air inlet 8.

In FIG. 2, the valve assembly 1 is shown in a fixed installation. In FIG. 3, a removable installation according to prior art is shown. The valve 10 is connected with the flow channel 9 by a flexible tubular piece 12 secured by tightening means 13 at the two ends.

In FIG. 4, a valve assembly 1 is shown. The diaphragm valve 10 comprises a first and a second chamber separated by a diaphragm or a membrane (not shown). The valve 10 is operated by control means, such as a solenoid valve or the like. When the valve is activated by moving the diaphragm, pressurized air flows from the first chamber to the valve outlet and into the flow passage 5. The diaphragm is provided with a small aperture through which the pressurized air flows into the second chamber and fills this chamber with air, so that equal pressures are established on both sides of the membrane/diaphragm. The pressure in the second chamber is applied to the entire surface of the membrane whereas only a minor portion of the membrane is subjected to the pressure in the first chamber. This presses the membrane against the valve exit and keeps the valve shut.

The second chamber is in communication with atmospheric pressure through a ventilation opening in the control valve. In its resting position, a piston of the control valve will keep the ventilation opening shut by retaining pressure in the second chamber and thereby keep the valve shut between the blast-cleaning shuts. When the control valve is activated, the piston is retracted and the pressurized retention air of the second chamber is quickly released out through the ventilation opening 18. The opening 18 is provided with an air flow tube 16 connected to the inlet 8 of the flow passage device 5 at the opposite end. Hereby, an explosion-like sound is avoided from the quick release of air when the valve is activated. Instead, the air is led into the flow passage, whereby the blasting effect of the valve may even be slightly enhanced.

In FIG. 5, a modification of the embodiment of FIG. 4 is shown. Here, the tubular pipe 16 is provided with an external supply of cool air through a conduit 17. When the valve is shut and no air is released through the flexible tube 16, external air may still be sucked into the flow passage through the inlet 8. The external air may either be atmospheric air or any other gaseous air supply.

By the invention it is realized that, apart from drawing in atmospheric air through the air inlet, other protective gases can be used without departing from the scope of the invention as defined in the claims.

What is claimed is:

1. A device for use in a cleaning installation for removing soot or similar inside deposits in a flow channel in a processing system by intermittently blasting a fluid or gaseous medium into the processing system via a valve means controlling the blasting, said device comprising a flow passage between the valve means and the flow channel, wherein the flow passage is provided with an inlet for allowing a continuous flow of a protective gas around the flow passage into the flow channel in the processing system.

2. A device according to claim 1, wherein the flow passage comprises an annular space between an inner tubular member and an outer tubular member, where the outer tubular member is provided with the inlet through which is provided a continuous gas flow around the flow passage into the flow channel in the processing system.

3. A device according to claim 2, wherein the gas inlet is provided with a flow restriction means that is replaceable.

4. A device according to claim 3, wherein the flow restriction means is a cover plate provided with at least one aperture through which air is allowed to flow into the annular spacing.

5. A device according to claim 1, wherein the inlet is provided with an injector for supplying the protective gas into the flow passage.

6. A device according to claim 1, wherein the device is provided with a plurality of air inlets for allowing the flow of the protective gas.

7. A cleaning installation for removing soot or similar inside deposits in a flow channel in a processing system by intermittently blasting a fluid or gaseous medium into the processing system, said cleaning installation comprising a pressure vessel that communicates with at least one valve assembly connected by a device including a flow passage to the flow channel in the processing system, and means for connecting respective ends of the device with at least one valve means and the flow passage of the associated processing system, wherein the flow passage is provided with an inlet allowing for a continuous flow of protective gas around the flow passage into the flow channel in the processing system.

8. A cleaning installation according to claim 7, wherein the flow passage comprises an annular space between an inner tubular and an outer tubular member, where the outer tubular member is provided with the continuous gas flow around the flow passage into the processing system.

9. A cleaning installation according to claim 8, wherein the gas inlet is provided with a flow restriction means that is replaceable.

10. A cleaning installation according to claim 9, wherein the flow restriction means is a cover plate provided with at least one aperture through which air is allowed to flow into the annular spacing.

11. A cleaning installation according to claim 7, wherein the inlet is provided with an injector for supplying the protective gas into the flow passage.

12. A cleaning installation according to claim 7, wherein the device is provided with a plurality of air inlets for allowing the flow of the protective gas.

* * * * *